US009285154B2

(12) United States Patent
Kim et al.

(10) Patent No.: US 9,285,154 B2
(45) Date of Patent: Mar. 15, 2016

(54) COOLING APPARATUS FOR A MACHINE ROOM OF A REFRIGERATOR USING A NACELLE-SHAPED DUCT

(75) Inventors: Hyun Kim, Changwon-si (KR); Kilyong Park, Changwon-si (KR)

(73) Assignee: LG ELECTRONICS INC., Seoul (KR)

( * ) Notice: Subject to any disclaimer, the term of this patent is extended or adjusted under 35 U.S.C. 154(b) by 444 days.

(21) Appl. No.: 13/609,927

(22) Filed: Sep. 11, 2012

(65) Prior Publication Data

US 2013/0067948 A1 Mar. 21, 2013

(30) Foreign Application Priority Data

Sep. 15, 2011 (KR) ..... 10-2011-0093097

(51) Int. Cl.
*F25D 3/08* (2006.01)
*F25D 23/00* (2006.01)

(52) U.S. Cl.
CPC ..... *F25D 23/003* (2013.01); *F25D 2323/0021* (2013.01); *F25D 2323/00282* (2013.01); *F25D 2323/00284* (2013.01)

(58) Field of Classification Search
CPC ..... F25D 23/003; F25D 2323/00282; F25D 2323/0021; F25D 2323/00284; F01D 1/00
USPC ..... 62/428; 415/90
See application file for complete search history.

(56) References Cited

U.S. PATENT DOCUMENTS 6,345,956 B1 * 2/2002 Lin ..... 416/178
2009/0169387 A1 * 7/2009 Yoo ..... F04D 29/4226 416/190

FOREIGN PATENT DOCUMENTS

GB 2452490 A * 3/2009 ..... F04D 25/08
JP 2010203444 A * 9/2010 ..... F04D 25/08

* cited by examiner

*Primary Examiner* — Emmanuel Duke
(74) *Attorney, Agent, or Firm* — Ked & Associates, LLP

(57) ABSTRACT

A cooling system for a machine room of a refrigerator is provided. More particularly, a cooling system for a machine room of a refrigerator is provided, which is capable of cooling the machine room of the refrigerator using a smaller blowing fan in a nacelle-shaped or nacelle duct, which can acquire more air than using conventional fan blades, remarkably reducing noise of the fan and ensuring sufficient space, thereby efficiently cooling the compressor and the condenser installed in the machine room. The apparatus for cooling a machine room of a refrigerator may include a compressor installed in the machine room, a condenser installed in the machine room and connected to the compressor via a connection pipe, and a nacelle duct installed in the machine room that cools the compressor and the condenser by blowing air, the nacelle duct having a central opening.

18 Claims, 5 Drawing Sheets

COOLING APPARATUS FOR A MACHINE ROOM OF A REFRIGERATOR USING A NACELLE-SHAPED DUCT

CROSS-REFERENCE TO RELATED APPLICATION(S)

The present application claims priority to Korean Application No. 10-2011-0093097, filed in Korea on Sep. 15, 2011, which is herein expressly incorporated by reference in its entirety.

BACKGROUND

1. Field

A cooling apparatus for a machine room of a refrigerator using a nacelle-shaped duct is disclosed herein.

2. Background

Cooling apparatuses are known. However, they suffer from various disadvantages.

BRIEF DESCRIPTION OF THE DRAWINGS

Embodiments will be described in detail with reference to the following drawings in which like reference numerals refer to like elements, and wherein.

DETAILED DESCRIPTION

Figure 1:
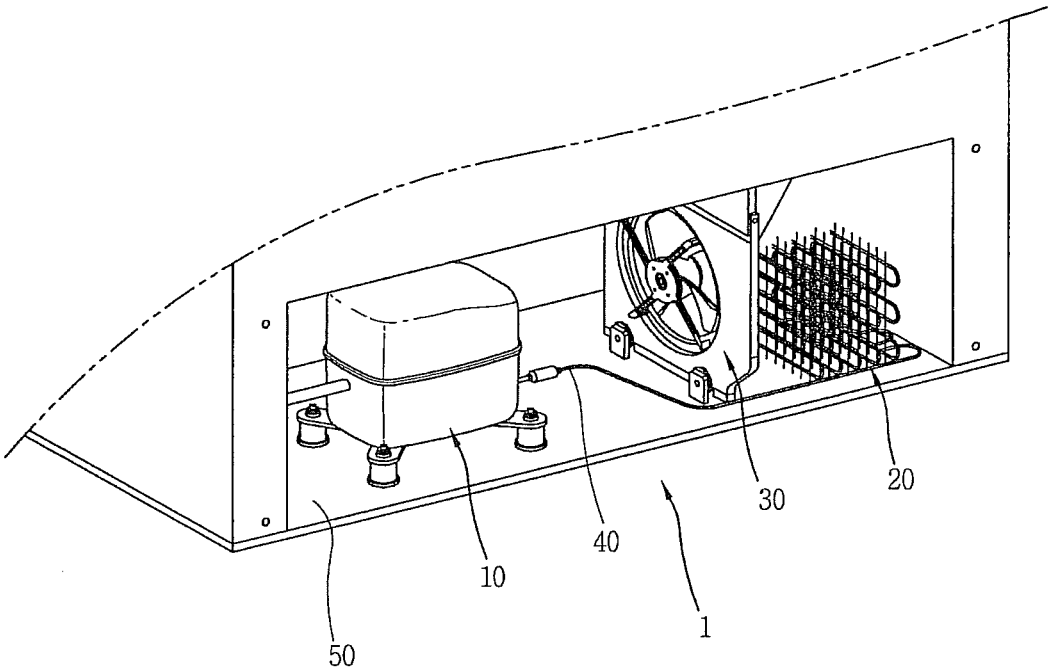
FIG. 1 is a perspective view of an apparatus for cooling a machine room of a refrigerator according to an embodiment.

Description will now be given in detail of an apparatus for cooling a machine room of a refrigerator using a nacelle shape according to embodiments, with reference to the accompanying drawings. Where possible, like reference numerals have been used to indicate like elements, and repetitive description has been omitted.

Technical terms used in this specification are used to merely illustrate specific embodiments, and should be understood that they are not intended to limit the present disclosure. As far as not being defined differently, all terms used herein including technical or scientific terms may have the same meaning as those generally understood by a person of ordinary skill in the art to which the present disclosure belongs, and should not be construed in an excessively comprehensive meaning or an excessively restricted meaning. In addition, if a technical term used in the description of the present disclosure is an erroneous term that fails to clearly express the idea of the present disclosure, it should be replaced by a technical term that can be properly understood by the skilled person in the art. In addition, general terms used in the description of the present disclosure should be construed according to definitions in dictionaries or according to its front or rear context, and should not be construed to have an excessively restrained meaning.

In general, a refrigerator is a freezing and refrigerating device capable of keeping food in a fresh state for a long period of time by lowering a temperature inside the refrigerator by means of repetition of a refrigeration cycle of compression-condensation-expansion-evaporation of a refrigerant.

FIG. 1 is a perspective view of an apparatus for cooling a machine room of a refrigerator according to an embodiment. The apparatus of FIG. 1 may include a compressor 10 that compresses a refrigerant of low temperature and low pressure into a refrigerant of high temperature and high pressure, and a condenser 20 that provides heat exchange between the refrigerant having passed through the compressor and external air, to perform the refrigeration cycle of the refrigerator.

The compressor 10 may be installed at one side in a machine room 1, and the condenser 20, which may generate a lot of heat, may be installed at a side of the compressor 10. The compressor 10 and the condenser 20 may be connected via a connection pipe 40, which may function as a refrigerant connection passage that allows the flow of the refrigerant. A cooling fan 30 may be located at a side of the condenser 20 and may be axially coupled to a motor (not shown), to cool the compressor 10 by forcibly blowing heat generated within the machine room 1, in particular, heat generated in the condenser 20.

A machine room case 50 may be provided that forms an outer wall of the machine room 1. The machine room case 50 may protect the components and may include a plurality of inlets for smooth cooling of the inside of the machine room 1.

With the above-described configuration of FIG. 1, while the refrigerator is driven, the compressor 10 and the condenser 20 installed within the machine room 1 run and accordingly generate heat. Simultaneously, with the rotation of the cooling fan 30 in response to the motor being driven, air may be introduced into the machine room 1 via the plurality of inlets of the case 50. The air introduced by the cooling fan 30 may be delivered to the condenser 20, discharging the heat generated by the condenser 30.

In the thusly-configured machine room of FIG. 1, the single cooling fan 30 may be used to cool the compressor 10, as well as the condenser 20, thereby generating a large quantity of heat. This may lower cooling efficiency. To overcome this problem, a size of the cooling fan or a number of turns thereof may be increased, which may cause an increase in vibration and noise.

Further, as the cooling fan 30 is located at one side of the condenser 20, air that flows through or by the condenser 20 may be heated. Accordingly, compression efficiency of the compressor may be lowered, thereby increasing power consumption. Also, air of a high temperature discharged at a front of the condenser 20 may be re-sucked via a suction portion, lowering a heat exchange rate of the condenser 20 by the cooling fan 30.

In such a cooling method for a machine room of a refrigerator, the compressor and condenser have been cooled using external air introduced in response to rotation of the fan blades of the cooling fan located within the machine room. However, the limited small space of the machine room may cause interference with other components upon installation, and the rotation of the fan blades may generate a lot of noise.

In contrast, in a cooling system for a machine room of a refrigerator using a nacelle-shaped duct or nacelle duct according to embodiments discussed herein below, more air may be acquired by a smaller cooling fan than the above-discussed cooling fan, and actually less air may be introduced by the cooling fan so as to reduce power consumption by a motor for driving the cooling fan. Also, interference of the fan blades with various components may be reduced or prevented, remarkably reducing noise due to the fan blades. In addition, with the installation of a nacelle-shaped duct or nacelle duct at an outside of the condenser, a space for the condensing system may be reduced when the condensing system is inserted into a central opening of the nacelle duct, maximizing space usage.

Hereinafter, description will be given in detail of an apparatus for cooling a machine room of a refrigerator using a nacelle-shaped duct or nacelle duct in accordance with embodiments, with reference to FIGS. 2 to 8.

Figure 2:
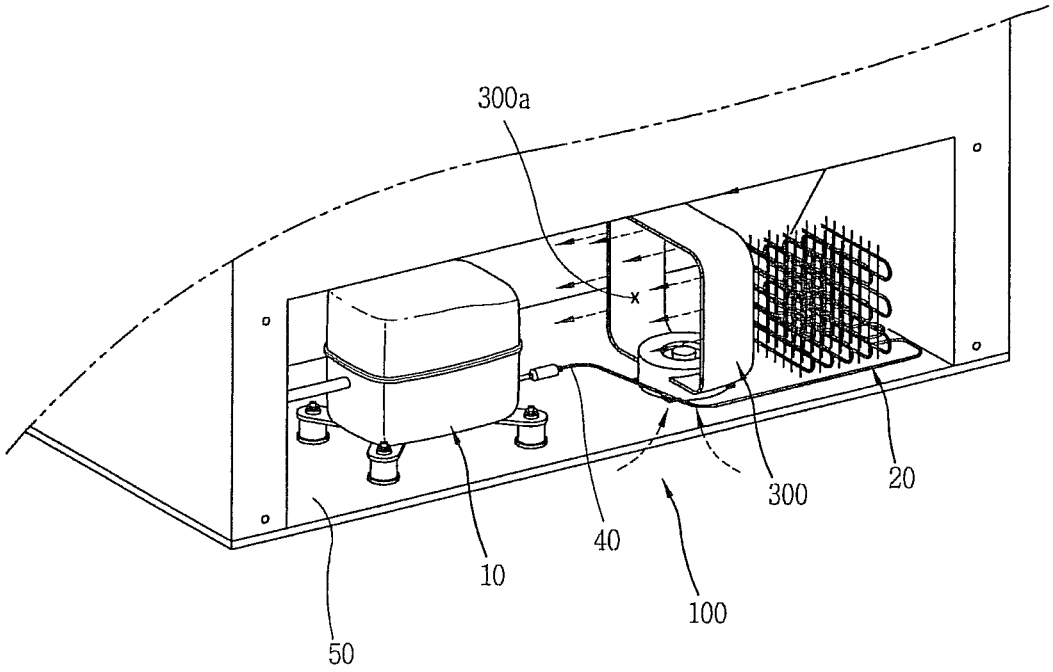
FIG. 2 is perspective view of an apparatus for cooling a machine room of a refrigerator using a nacelle-shaped duct or nacelle duct in accordance with an embodiment.
Figure 3:
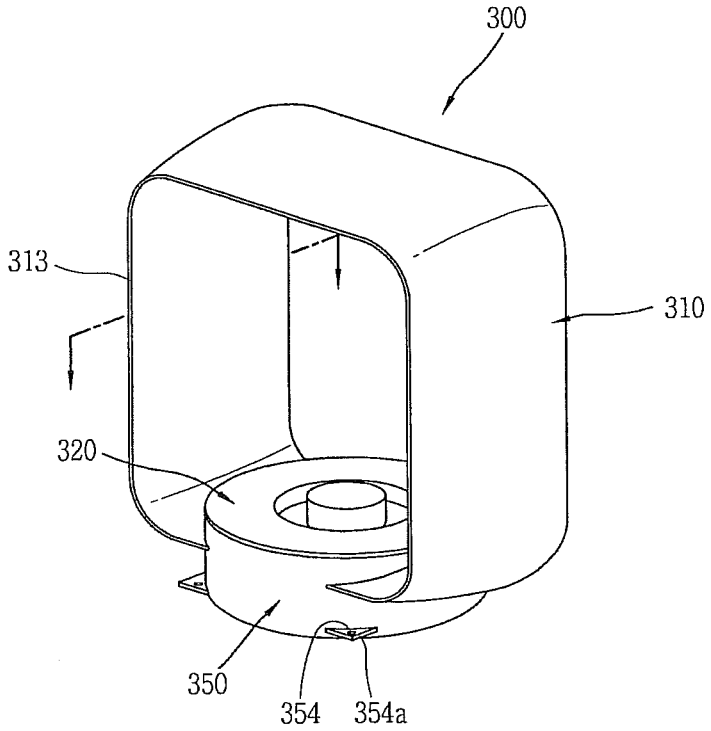
FIG. 3 is a perspective view showing the nacelle duct of the apparatus for cooling a machine room of a refrigerator of FIG. 2.
Figure 4:
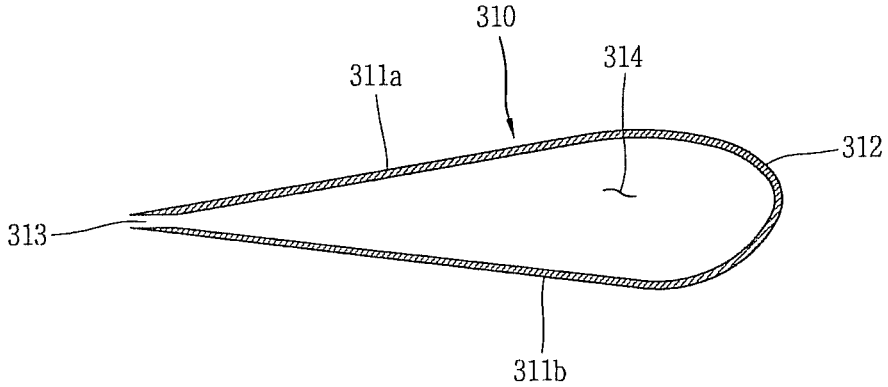
FIG. 4 is a sectional view of a blowing device of the nacelle duct of FIG. 3.
Figure 5:
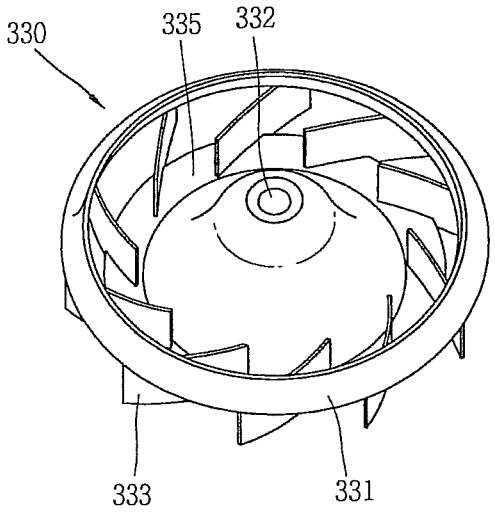
FIG. 5 is a perspective view of a cover of the nacelle duct of FIG. 3.
Figure 6:
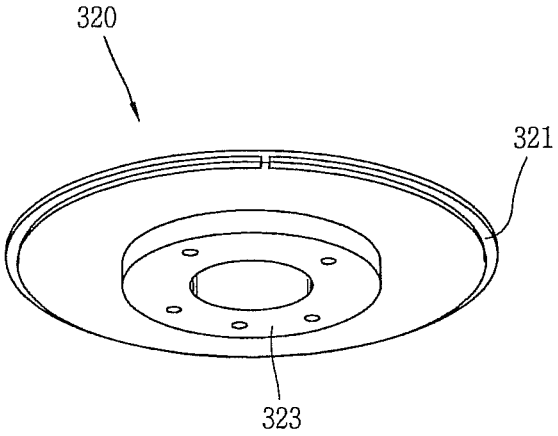
FIG. 6 is a perspective view of a blowing fan of the nacelle duct of FIG. 3.
Figure 7:
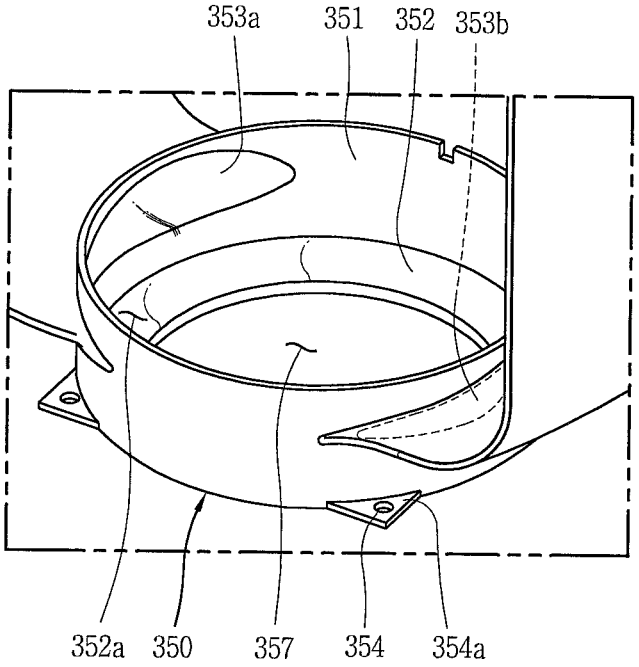
FIG. 7 is a perspective view illustrating a fan mounting device of the nacelle duct of FIG. 3.
Figure 8:
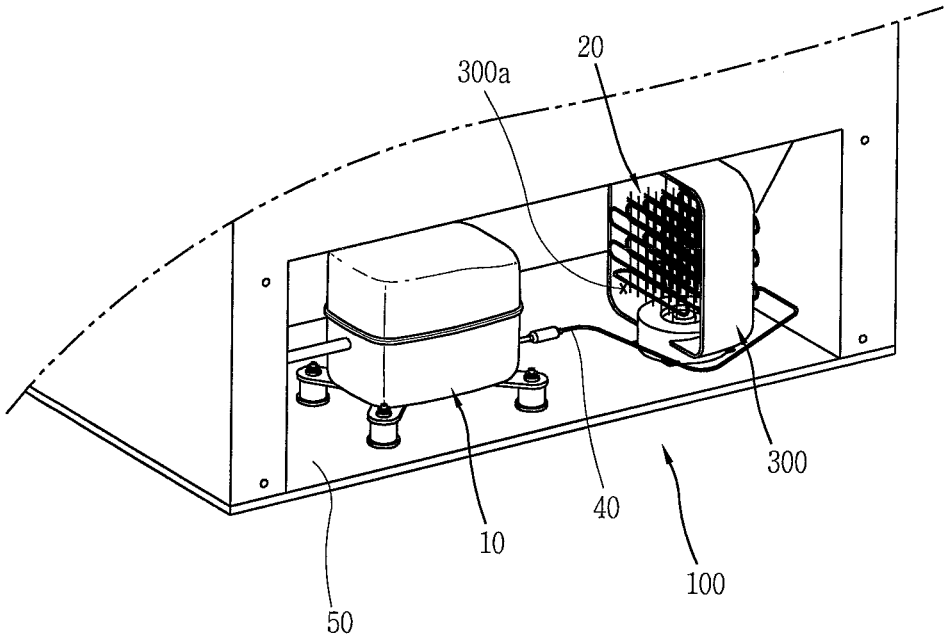
FIG. 8 is a perspective view of an apparatus for cooling a machine room of a refrigerator according to an embodiment, in which a condenser is inserted into a central opening of a nacelle duct.

FIG. 2 is a perspective view of an apparatus for cooling a machine room of a refrigerator using a nacelle-shaped duct or nacelle duct in accordance with an embodiment. FIG. 3 is a perspective view showing the nacelle duct of the apparatus for cooling a machine room of a refrigerator of FIG. 2. FIG. 4 is a sectional view of a blowing device of the nacelle duct of FIG. 3. FIG. 5 is a perspective view of a cover of the nacelle duct of FIG. 3. FIG. 6 is a perspective view of a blowing fan of the nacelle duct of FIG. 3. FIG. 7 is a perspective view of a fan mounting device of the nacelle duct of FIG. 3. FIG. 8 is a perspective view showing an inserted state of a condenser into a central opening of a nacelle duct in accordance with another embodiment.

An apparatus for cooling a machine room 100 of a refrigerator using a nacelle-shaped duct or nacelle duct according to embodiments, as shown in FIG. 2, may include a compressor 10 installed in the machine room 100, a condenser 20 connected to the compressor 10 via a connection pipe 40 within the machine room 100, and a nacelle-shaped duct or nacelle duct 300 installed in the machine room 100 to cool the compressor 10 and the condenser 20. The nacelle duct 300 may include a central opening 300*a*.

As shown in FIG. 2, the machine room 100 of the refrigerator is generally located at a lower portion of the refrigerator and enclosed by a case 50. In the enclosed space, the compressor 10 and the condenser 20 may be connected via the connection pipe 40 to circulate refrigerant into the refrigerator. As the compressor 10 and the condenser 20 run within the machine room 100, heat may be generated and accordingly a system for cooling the heat may be provided. The embodiments of FIGS. 2-8 utilize a nacelle duct 300 as a cooling structure.

The nacelle duct 300 may include a non-exposed blade-type blowing fan disposed at or in an opening formed at a central portion thereof, and a blade or blades of the blowing fan may not be exposed. Referring to FIG. 2, the nacelle duct 300 may be installed between the compressor 10 and the condenser 20 and may be spaced a predetermined distance from each and may blow air or wind only toward the compressor 10, which generates more heat.

The nacelle duct 300 may not blow internal air of the machine room 100, but rather, may blow external air introduced into the machine room 100. Referring to FIG. 2, external air may be sucked in from a lower side of the nacelle duct 300 to be used for the cooling operation.

The nacelle duct 300 will be described with reference to FIG. 3. The nacelle duct 300 may include a blowing device 310 having an air flow path 314 that functions as an internal path through which air flows and a blow nozzle 313 that discharges the flowing air, a fan mounting device 350 connected to the blowing device 310 at a lower portion of the nacelle duct 300 and provided to mount a blowing fan 330 therein, the blowing fan 330 being installed in the fan mounting device 350 to suck in external air and blow it toward the blowing device 310, and a cover 320 that covers an upper portion of the fan mounting device 350 and prevents the flow of air from being discharged to the outside.

As shown in FIG. 3, the nacelle duct 300 may have a closed structure except for the blow nozzle 313 of the blowing device 310 to prevent the introduction of internal air from the machine room 100, and may employ a frame structure having an open central portion which has a shape similar to a square. Accordingly, the blowing fan 330 may be mounted to the fan mounting device 350 and obscured by the cover 320, thereby preventing it from being externally exposed. As the blowing fan 330 operates in the machine room 100 without being exposed, it may avoid collision with other components within the machine room 100 and be free from dust in the machine room 100, resulting in an improved performance.

Referring to FIGS. 3 and 4, the blowing device 310 may have a streamlined cross-section. The blowing device 310 may include the blow nozzle 313 located at a front thereof, an outer barrier 311*a*, an inner barrier 311*b* and a rear curved portion 312, to thereby blow introduced air toward the front of blow nozzle 313.

The air flow path 314 of the blowing device 310, as shown in the cross-sectional view of FIG. 4, may be formed as a hollow pipe having a shape similar to "n". In the air flow path 314, the blow nozzle 313 may be located to face the compressor 10, and accordingly inject air sucked in from the fan mounting device 350 toward the compressor 20, cooling the machine room 100.

The air flow path 314 may be a hollow space formed within the square-like frame of the blowing device 310, and may allow external air sucked in by the blowing fan 330 to be discharged via the blow nozzle 313 by flowing up from a lower portion thereof. The air flow path 314 may be defined by the outer barrier 311*a* and the inner barrier 311*b* formed as flat plates and the rear curved portion 312 formed at a rear thereof and facing the condenser 20, to minimize resistance of the air flow. A front surface of the air flow path 314 is shown having the blow nozzle 313 as a cut-off groove that blows air toward the compressor 10, in accordance with this embodiment.

The blow nozzle 313, referring to FIGS. 3 and 4, may correspond to a portion through which blown air is discharged, regarding the cross-section of the air flowing path 314, and may be formed in various shapes, generally, protruding forwardly to minimize resistance of the air discharge.

Hereinafter, description will be given of the blowing fan 330 with reference to FIG. 5. The blowing fan 330 may include a plurality of blades 333 that blows sucked in external air, a blade fixing portion 335 that fixes one end of each of the blades thereto, and a drive shaft 332 connected to a drive motor (not shown) that rotates the plurality of blades 333.

The blowing fan 330 may be disposed inside the fan mounting device 350. The blowing fan 330 may be driven by the drive motor (not shown) and function as a cooling fan. That is, the blowing fan 330 may be located in a lower portion of the nacelle duct 300 in a non-exposed state, so as to induce air introduced via an external air inlet 357 in the form of a lower open space, which will be explained later, toward sides to be blown into the air flow path 314 of the blowing device 310.

Without exposing the blowing fan 330 in the machine room 100, noise generated due to rotation of the blowing fan 330 within a sealed space may be reduced, and interference with other components within the machine room 100 may be avoided, preventing mis-operation. In addition, installation of the blowing fan 330 inside the space defined by the sealed fan mounting device 350 and cover 320 may result in an increase in cooling efficiency due to protection of the blowing fan 330 from contaminants, such as dust, within the machine room 100, and improvement of durability due to the rare need to clean the blowing fan 330.

The plurality of blades 333 may blow external air sucked in from the lower portion toward side surfaces of the fan mounting device 350. As shown in FIG. 5, the plurality of blades 33 may include a plurality of plates, which extend vertically to generate air or wind in an outer circumferential direction, may be spirally installed on the plate fixing portion 335.

Referring to FIG. 5, the blowing fan 330 may further include a blade frame 331 that circularly fixes the other end of each of the plurality of blades 333. As one end of each of the plurality of blades 333 may be fixed to the blade fixing portion 335, damage to the plurality of blades 333 due to strong rotation may be a concern. To overcome this concern, the circular blade frame 331 may be installed to integrally fix the other ends of the plurality of blades 333, enhancing durability of the plurality of blades 333.

The drive shaft 331 may be connected to a rotational shaft of the drive motor (not shown) located at the lower portion of the nacelle duct 300, to rotate the blowing fan 330.

The cover 320, as shown in FIG. 6, may be formed as a circular plate. A mounting recess 321 that fixes the cover 320 onto the fan mounting device 350 may be formed along an outer edge of the cover 320. Also, the cover 320 may include a drive shaft inserting portion 323 configured to receive insertion of the driving shaft 332 therein.

The mounting recess 321 may be designed to correspond to a shape of an upper portion of the fan mounting device 350, such that the cover 320 may be engaged with the corresponding upper portion in a sealed state. The drive shaft inserting portion 323 may allow for insertion of the drive shaft 332 of the blowing fan 330 therein, facilitating rotation of the blowing fan 330.

The fan mounting device 350, referring to FIG. 7, may be formed in a cylindrical shape to define a space in which the blowing fan 330 may be inserted. The upper portion of the fan mounting device 350 may be shielded by the cover 320.

The fan mounting device 350 may include the external air inlet 357 formed at a lower portion thereof for introduction of external air therethrough. Accordingly, the external air may be used to cool the machine room 100 of the refrigerator. That is, the blowing fan 330 may blow air introduced via the external air inlet 357 toward the sides of the fan-mounting device 350, such that the air may flow via the air flow path 314 of the blowing device 310.

The external air inlet 357, referring to FIG. 7, corresponds to the lower open portion of the fan mounting device 350. A drive motor (not shown) may be installed at the lower portion of the external air inlet 357, avoiding blocking of the external air inlet 357 for smooth introduction of external air.

In accordance with embodiments, internal air of the machine room 100 may be heated due to the compressor 10 and the condenser 20. Therefore, the internal air of the machine room 100 may not be utilized, but rather, external air introduced into the machine room 100 may be used to cool the machine room 100, improving cooling efficiency.

The fan mounting device 350 may include an outer casing 351 that functions as an external barrier that surrounds an outer circumference of the blowing fan 330, a recessed portion 352, in which the blowing fan 330 may be inserted with a spaced gap 352*a* therebetween, and blow openings 353*a* and 353*b* that allow air generated by the blowing fan 330 to be discharged toward or into the blowing device 310.

The outer casing 351, as shown in FIG. 7, may be a barrier formed in a cylindrical shape. A lower portion of the outer casing 351 may be open to define the external air inlet 357 and its upper portion may be closed by the cover 320.

The recessed portion 352 may be formed along an inner circumferential surface of the outer casing 351. An edge portion of each blade 333 of the blowing fan 330 may rotate along the recessed portion 351 such that the external air flows. With the plurality of blades 333 fixedly reinforced by the blade frame 331, the blade frame 331 may be inserted into the recessed portion 352 with the spaced gap 352*a* therebetween, smoothing rotation of the blowing fan 330.

The blow openings 353*a* and 353*b* may be through holes formed at portions where the blowing device 310 and the fan mounting device 350 are engaged with each other. The formation of the blow openings 353*a* and 353*b* may allow air generated by the blowing fan 330 to flow toward the air flowing path 314 of the blowing device 310. The blow openings 353*a* and 353*b*, as shown in FIG. 7, may be formed at positions facing each other on an inner circumferential surface of the outer casing 351.

The fan mounting device 350 may include duct fixing holes 354 formed at a lower side of an outer circumference of the outer casing 351 to fix the nacelle duct 300 onto a bottom of the machine room 100. The duct fixing holes 354 may be fixing holes formed at or on protruding ribs 354*a* to fix that nacelle duct 300 using, for example, bolts.

FIG. 8 is a perspective view of an apparatus for cooling a machine room of a refrigerator according to another embodiment. With this embodiment, a condenser is inserted into a central opening of a nacelle duct. That is, with this embodiment, the condenser 20 may be located in a central opening 300*a* of the blowing device 310 of the nacelle duct 300. This may enhance spatial efficiency of the machine room 100. In general, in the apparatus for cooling a machine room having the cooling fan 30 of FIG. 1, a lot of heat is generated by the compressor 10. Hence, most of the air is blown toward the compressor 10 to implement a cooling function. However, the condenser 20 may also generate heat. Eventually, the air heated by the condenser 20 may be blown to the compressor 10.

A system that cools the compressor 10 using air heated air by the condenser 20 via the cooling fan 30 may have extremely low cooling efficiency. In contrast, FIG. 8 shows a structure for sucking external air to cool the compressor 10. The blowing device 310 of the nacelle duct 300 may be in the form of a square frame, which is open (penetrates). The condenser 20 may be installed in the central opening 300*a*, which may ensure sufficient space in a horizontal direction, resulting in maximization of spatial efficiency.

The foregoing embodiments and advantages are merely exemplary and are not to be construed as limiting the present disclosure. The present teachings may be readily applied to other types of apparatuses. This description is intended to be illustrative, and not to limit the scope of the claims. Many alternatives, modifications, and variations will be apparent to those skilled in the art. The features, structures, methods, and other characteristics of embodiments described herein may be combined in various ways to obtain additional and/or alternative embodiments.

As the present features may be embodied in several forms without departing from characteristics thereof, it should also be understood that the above-described embodiments are not limited by any of the details of the foregoing description, unless otherwise specified, but rather, should be construed broadly within its scope as defined in the appended claims, and therefore all changes and modifications that fall within the metes and bounds of the claims, or equivalents of such metes and bounds are therefore intended to be embraced by the appended claims.

Embodiments disclosed herein provide an apparatus for cooling a machine room of a refrigerator using a nacelle shape or nacelle-shaped or nacelle duct, capable of increasing cooling efficiency by sucking external air into a machine room by virtue of an improved cooling structure of the machine room, increasing compression and condensation efficiencies responsive to the increase in the cooling efficiency, and preventing noise generation by installing a cooling fan in a lower portion of the nacelle duct without being exposed.

Embodiments disclosed herein further provide an apparatus for cooling a machine room of a refrigerator using a nacelle shape or nacelle-shaped or nacelle duct, capable of achieving a cooling effect using a smaller cooling fan, which is installed in a lower portion of a separate nacelle duct without being exposed to suck external air and cool the machine room using the sucked external air.

Embodiments disclosed herein further provide an apparatus for cooling a machine room of a refrigerator, capable of enhancing spatial efficiency within the machine room by installing a condenser in a central opening formed at a blowing unit or device of a nacelle-shaped or nacelle duct.

Embodiments disclosed herein provide an apparatus for cooling a machine room of a refrigerator using a nacelle shape or nacelle-shaped or nacelle duct. The apparatus may include a compressor installed in the machine room, a condenser installed in the machine room and connected to the compressor via a connection pipe, and a nacelle duct installed in the machine room to cool the compressor and the condenser by blowing air, and having a central opening.

The nacelle duct may include a blowing unit or device having the central opening, the blowing unit having an air flowing path as an internal path for air flow and a blowing nozzle that discharges air, a fan mounting unit or device connected to the blowing unit at a lower portion of the nacelle duct and configured to mount a blowing fan therein, a blowing fan installed in the fan mounting unit to suck external air and blow the sucked external air toward the blowing unit, and a cover configured to cover an upper portion of the fan mounting unit and prevent air from being discharged to the exterior. The fan mounting unit may include an external air inlet formed at a lower portion thereof for introduction of the external air, which may be used to cool the machine room.

The blowing unit may have a streamlined section, and include the blowing nozzle located at the front, an outer barrier, an inner barrier, and a rear curved portion, so as to blow introduced air toward the front blowing nozzle. The fan mounting unit may include an outer casing as an external barrier that surrounds an outer circumference of the blowing fan, a recessed portion configured to allow the blowing fan to be inserted therein with a space gap therebetween, and blowing openings configured to allow air generated by the blowing fan to be discharged toward the blowing unit. The blowing openings may be formed at positions facing each other on the outer casing so as to blow air toward the blowing unit.

The fan mounting unit may include duct fixing holes to fix the nacelle duct onto a bottom of the machine room. The blowing fan may include a plurality of blades that blows sucked air, a blade fixing portion to which one end of each of the plurality of blades is fixed, and a driving shaft connected to a driving motor that rotates the plurality of blades. The blowing fan may further include a blade frame that circularly fixes the other end of each of the plurality of blades.

The cover may include a mounting recess fixed onto an upper portion of the fan mounting unit, and a driving shaft inserting portion in which the driving shaft of the blowing fan is inserted. The condenser may be located in the central opening of the blowing unit to enhance spatial efficiency of the machine room.

With embodiments disclosed herein, cooling may be performed by using introduced external air for enhancement of cooling efficiency and a smaller blowing fan may be installed in a lower portion of a nacelle duct without being exposed. This may maximize the introduction of external air even using the smaller fan, and noise generated by the blowing fan may be reduced without an excessive increase in number of turns of the blowing fan.

Embodiments disclosed herein may reduce problems associated with the lowering of cooling efficiency due to reuse of air at high temperature generated by a compressor within a machine room and the lowering of cooling efficiency with respect to the compressor by the condenser, which may result in an increase in compression efficiency of the compressor and a reduction in power consumption of the refrigerator. The condenser may be disposed in a central opening formed at or in the blowing unit or device of the nacelle duct, maximizing an overall space usage of the machine room.

Components of embodiments disclosed herein may be added to the internal structure of related art machine rooms without a great change. This may reduce fabricating costs of the refrigerator and also may allow for fabrication of a refrigerator having an improved function using the related art refrigerator. Without exposing the blowing fan in the machine room, noise generated due to rotation of the blowing fan within a sealed space may be reduced, and interference with other components within the machine room may be avoided, preventing mis-operation.

The cooling fan may be installed in a sealed space by a fan mounting unit and a cover, so as to be free from contaminants, such as dust, in the machine room, which may result in an increase in cooling efficiency. Also, cleaning management may be rarely required by virtue of the configuration, resulting in enhanced durability.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. An apparatus for cooling a machine room of a refrigerator, the apparatus comprising:
a compressor installed in the machine room;
a condenser installed in the machine room and connected to the compressor via a connection pipe;
a nacelle duct installed in the machine room that cools the compressor and the condenser by blowing air, the nacelle duct having a central opening; and
a machine room case forming an outer wall of the machine room and including at least one inlet located at a bottom surface of the machine room case to face a lower portion of the nacelle duct, wherein the nacelle duct comprises:
a blowing device having the central opening, the blowing device having an air flow path that functions as an internal path for air flow and a blow nozzle that discharges air;
a fan mounting device connected to the blowing device at a lower portion of the nacelle duct and fixed on the bottom surface of the machine room case to correspond to the inlet of the machine room case; and
a blowing fan installed in the fan mounting device to suck in external air and blow the sucked in external air toward the blowing device, wherein the fan mounting device comprises an external air inlet located to face the inlet of the machine room case to form a direct introduction path for the external air, the external air being used to cool the machine room.

2. The apparatus of claim 1, wherein the nacelle duct further comprises:
a cover configured to cover an upper portion of the fan mounting device and prevent air from being discharged to the exterior through the upper portion of the fan mounting device.

3. The apparatus of claim 2, wherein the blowing fan comprises:
a plurality of blades that blow sucked in air;
a blade fixing portion, to which a first end of each of the blades is fixed; and
a drive shaft configured to be connected to a drive motor that rotates the plurality of blades.

4. The apparatus of claim 3, wherein the blowing fan further comprises a blade frame that fixes a second end of each of the plurality of blades.

5. The apparatus of claim 4, wherein the blade frame encircles the second ends of the plurality of blades.

6. The apparatus of claim 3, wherein the plurality of blades is oriented to generate air flow in an outer circumferential direction.

7. The apparatus of claim 3, wherein the cover comprises:
a mounting recess configured to be fixed onto an upper portion of the fan mounting device; and
a drive shaft inserting portion through which the drive shaft of the blowing fan is inserted.

8. The apparatus of claim 1, wherein the blowing device has a streamlined section and includes the blowing nozzle located at a front thereof, an outer barrier, an inner barrier, and a rear curved portion, so as to blow air introduced therein toward the blow nozzle.

9. The apparatus of claim 1, wherein the fan mounting device comprises:
an outer casing that functions as an external barrier that surrounds an outer circumference of the blowing fan; and
a recessed portion configured to allow the blowing fan to be inserted therein with a spaced gap therebetween.

10. The apparatus of claim 9, wherein the fan mounting device further comprises:
a plurality of blow openings configured to allow air generated by the blowing fan to be discharged to the blowing device.

11. The apparatus of claim 10, wherein the plurality of blow openings are formed at positions facing each other on the outer casing so as to blow air toward the blowing device.

12. The apparatus of claim 9, wherein the fan mounting device comprises one or more duct fixing holes that fix the nacelle duct onto a bottom of the machine room.

13. The apparatus of claim 1, wherein the condenser is located in the central opening of the blowing device to enhance spatial efficiency of the machine room.

14. An apparatus for cooling a machine room of a refrigerator, the apparatus comprising:
a compressor installed in the machine room;
a condenser installed in the machine room and in communication with the compressor;
a nacelle duct installed in the machine room that cools the compressor and the condenser by blowing air, the nacelle duct having a central opening, wherein the condenser is positioned in the central opening; and
a machine room case forming an outer wall of the machine room and including at least one inlet located at a bottom surface of the machine room case to face a lower portion of the nacelle duct, wherein the nacelle duct comprises:
a blowing device having the central opening, the blowing device having an air flow path that functions as an internal path for air flow and a blow nozzle that discharges air;
a fan mounting device connected to the blowing device at a lower portion of the nacelle duct and fixed on the bottom surface of the machine room case to correspond to the inlet of the machine room case; and
a blowing fan installed in the fan mounting device to suck in external air and blow the sucked in external air toward the blowing device, wherein the fan mounting device comprises an external air inlet located to face the inlet of the machine room case to form a direct introduction path for the external air, the external air being used to cool the machine room.

15. The apparatus of claim 14, wherein the nacelle duct further comprises:
a cover configured to cover an upper portion of the fan mounting device and prevent air from being discharged to the exterior through the upper portion of the fan mounting device.

16. The apparatus of claim 14, wherein the blowing device has a streamlined section and includes the blowing nozzle located at a front thereof, an outer barrier, an inner barrier, and a rear curved portion, so as to blow air introduced therein toward the blow nozzle.

17. The apparatus of claim 14, wherein the fan mounting device comprises:
an outer casing that functions as an external barrier that surrounds an outer circumference of the blowing fan; and
a recessed portion configured to allow the blowing fan to be inserted therein with a spaced gap therebetween.

18. The apparatus of claim 14, wherein the blowing fan comprises:
a plurality of blades that blow sucked in air;
a blade fixing portion, to which a first end of each of the blades is fixed; and a drive shaft configured to be connected to a drive motor that rotates the plurality of blades.

* * * * *